United States Patent [19]

Peters et al.

[11] Patent Number: 4,815,719

[45] Date of Patent: Mar. 28, 1989

[54] CHAIN CLAMPING DEVICE

[75] Inventors: Theodore M. Peters, Libertyville, Ill.; Bjorn V. Eltvik, Arboga, Sweden

[73] Assignee: Car-O-Liner Company, Wixom, Mich.

[21] Appl. No.: 147,160

[22] Filed: Jan. 22, 1988

[30] Foreign Application Priority Data

Feb. 2, 1987 [SE] Sweden ..... 8700384

[51] Int. Cl.[4] ..... B21D 01/12

[52] U.S. Cl. ..... 269/130; 72/705

[58] Field of Search ..... 269/303, 132, 131, 130; 24/135 R, 135 A; 72/422, 705

[56] References Cited

U.S. PATENT DOCUMENTS 2,450,967 10/1948 Keiser ..... 269/131

3,881,715 5/1975 Creek ..... 269/131

*Primary Examiner*—Lowell A. Larson

*Attorney, Agent, or Firm*—Barnes, Kisselle, Raisch, Choate, Whittemore & Hulbert

[57] ABSTRACT

A clamping device with a support having a seat for receiving an object to be clamped and at least one clamping chain for abutment with the object to hold the object on the support. The chain is received in a pocket on the support and releasably secured therein by a clamp. A tensioner draws the chain into firm engagement with the object to secure it to the support.

11 Claims, 2 Drawing Sheets

CHAIN CLAMPING DEVICE

FIELD OF THE INVENTION

This invention relates to a clamping device, and more particularly to a clamping device for securing the frame of a damaged vehicle such that the frame will be held in the desired position even when powerful tension forces and straightening forces are applied to the damaged vehicle.

BACKGROUND

U.S. Pat. No. 3,669,439 discloses a clamping device with a chain used for securing cylindrical objects such as generators, motors and the like. This device is intended solely for securing an object in a desired position without any load bearing on it. This device is not suitable for securing and holding an object in a given fixed position when subjected to a large load. These devices often have one end of the chain secured in position by a locking pin inserted between two adjacent links of the chain which results in wear on the links and makes positioning the chain difficult. Furthermore, if the object so clamped is subjected to a large force placing the chain in tension the locking pin will be deformed or bent.

SUMMARY OF THE INVENTION

A clamping device of this invention has a support with a seat on which an object is releasably secured by at least one chain bearing on the object and urging it onto the seat. A clamp releasably secures in fixed relation to the support a portion of the chain in a pocket carried by the support. To fixedly clamp the object to the seat the chain is tensioned by a device connected to the chain and releasably carried by the support.

Objects, features and advantages of this invention are to provide a clamping device particularly suitable for securing a load carrying frame of a damaged vehicle to an alignment bench for straightening purposes in a given fixed position even when powerful tension forces and straightening forces are applied to the damaged vehicle, which can readily accommodate frames and other objects of varying size and shape, is a simple, stable, reliable, and quick and easy to use clamp, and is of relatively simple design and economical manufacture and assembly.

BRIEF DESCRIPTION OF THE DRAWINGS

These and other objects, features and advantages of this invention will be apparent from the following detailed description, appended claims and accompanying drawings in which:

DETAILED DESCRIPTION

Figure 1:
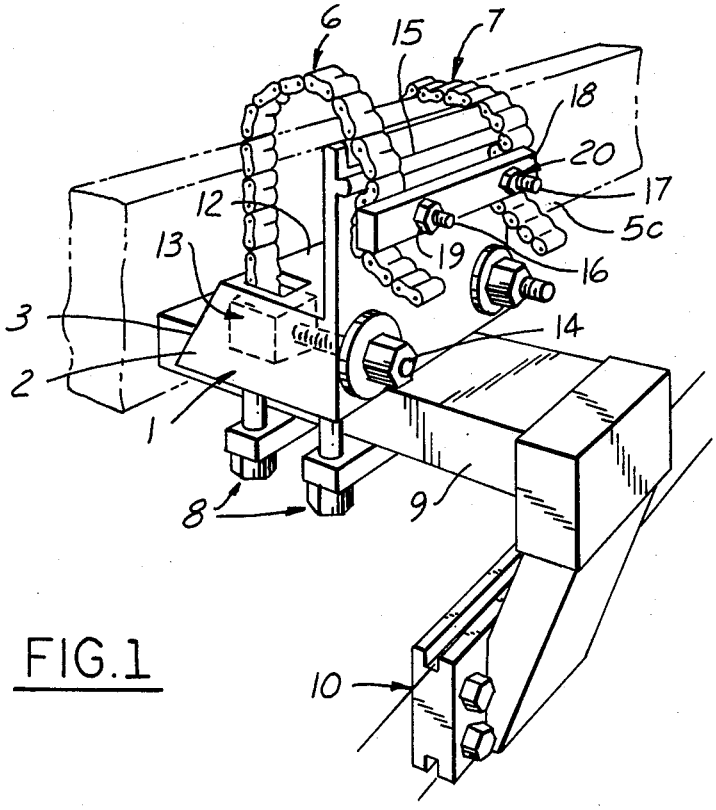
FIG. 1 is a perspective view of the clamping device of this invention securing a vehicle frame member to a straightening bench.
Figure 6:
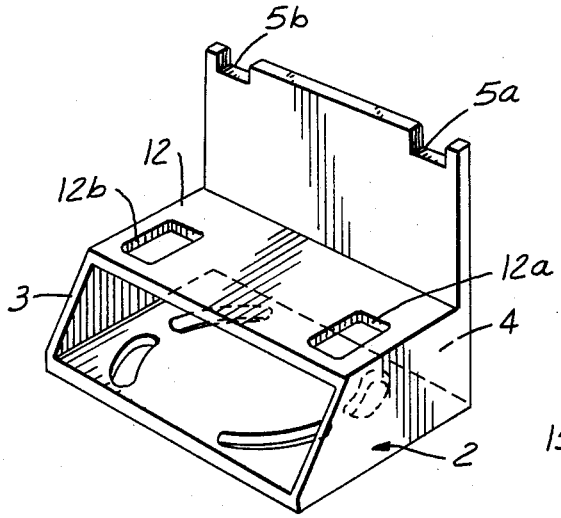
FIGS. 6 and 7 are perspective, enlarged views of a support housing of the clamping device of FIG. 1.
Figure 7:
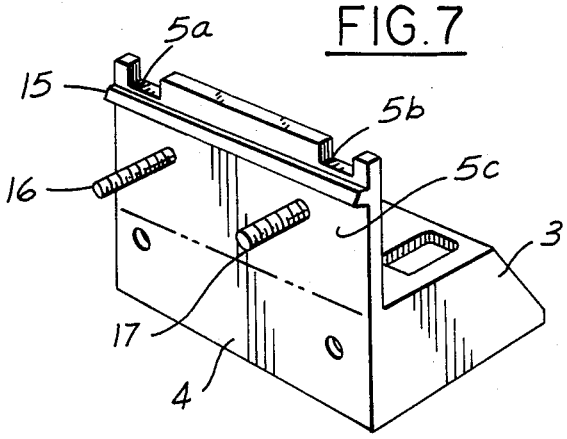

Referring in more detail to the drawings, FIG. 1 illustrates a clamping device 1 embodying this invention with a support housing 2 which forms a seat for the object to be secured to the clamping device and a pair of spaced apart chains 6 and 7 for securing an object such as a vehicle frame member 11 to the housing. Each chain is releasably secured to the housing by a clamp 20 and drawn into firm engagement with the frame member by a tensioner 13.

The housing 2 is movably mounted on a guide beam 9, by screw clamps 8. The beam 9 is fixedly mounted on a partially illustrated alignment or straightening bench 10, for supporting a deformed vehicle chassis in a manner to enable the chassis to be straightened and restored to its original or non-deformed state. The chassis is held firmly by a plurality of clamping devices 1 each secured to the bench. Usually, the vehicle chassis has a so-called box frame member 11 or members which extend around the chassis.

Preferably, the housing 1 has a box-like base with spaced apart and closed end walls 3, an upstanding side wall 4 with a vertically extending portion forming an attachment flange 5, and a bottom wall which bears on and is attached to the guide 9. The base also has a top wall 12 providing a horizontal support surface and an open side, which is preferably bevelled and provides access to the fastener bolts of the clamps 8 and the chain tensioners 13. The flange 5 and horizontal top 12 provide a generally right angle seat for supporting the frame member 11 with a snug fit. The bottom wall has a plurality of arcuate slots or openings for receiving the head end of the fastener of the screw clamps 8 for mounting the housing on the guide means 9.

Figure 4:
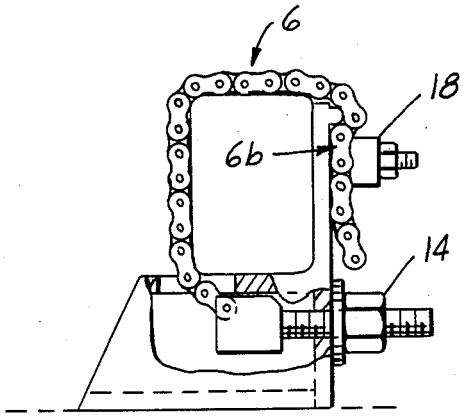
Figure 5:
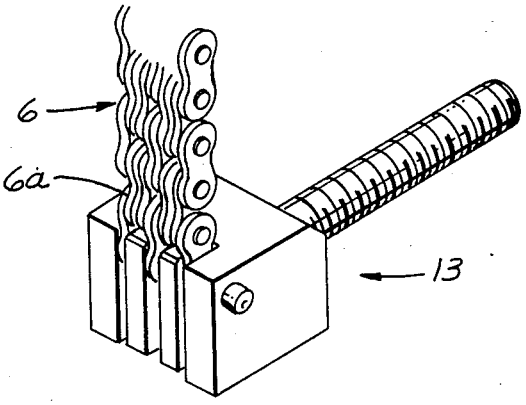
FIG. 5 is an enlarged perspective view of a chain tensioner of the clamping device of FIG. 1.

Each roller chain 6 and 7 passes around the frame member 11 through an opening **12*a* or 12*b* in the top wall 12 and is connected to a tensioner device 13 received in the housing. As shown in FIG. 5 each tensioner has a block fixed to a threaded spindle which projects through a hole in the side wall 4 of the housing with a washer and threaded nut 14 received thereon. Preferably, the end of the chain is pivotally connected to the block by a pin received in a bore through the block and projecting through holes of the end link of the roller chain. As shown in FIG. 4, when the device 13 tensions the chain preferably its block bears on the underside of the top wall 12**.

Figure 3:
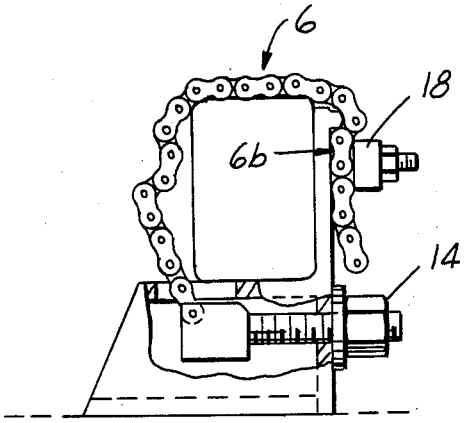

In use of this device, a portion of each chain adjacent its other end is releasably secured to the outer face **5*c* of the flange 5 by the clamp 20. Each chain passes over a horizontally extending and preferably substantially cylindrical rib 15, which along with the flange 5 defines a pocket or recess in which a portion of the chain is clamped. The rib 15 may be formed either integrally with the flange or separately welded to it. A clamp bar 18 normally overlies the chain and is received on a pair of threaded studs 16 and 17 projecting outwardly from and preferably fixed to the flange. The studs are each located below the rib 15 and as shown in FIGS. 3 and 4 preferably each spaced from it a distance approximately equal to one link spacing of the chain. Portions of the chains, such as 6*b*, below the rib are urged into firm engagement with the flange, by tightening nuts 19 threaded on the studs 16 and 17** and bearing on the clamp bar.

As shown in FIGS. 3 and 4, each chain, such as the chain 6, is forced by the clamp bar to "click" or "snap" in beneath the rib 15 so as to bear against the outer flange surface **5*c* when the chain is clamped to the flange by the clamping bar. Thus, the rear or lower side of the rib 15 and the adjacent outer flange surface 5*c*** together form a chain pocket in which one or more links of each chain are clamped by the clamping bar and held against the outer flange surface 5c and the end of one link such as 6b underlies and can bear on the rear or lower side of the rib 15 to lock the chain therein. If desired, this chain pocket can also be provided in the outer flange surface by a recess therein receiving at least one link of the chain when it is forced into the recess and securely held therein by the clamp bar 18.

Figure 2:
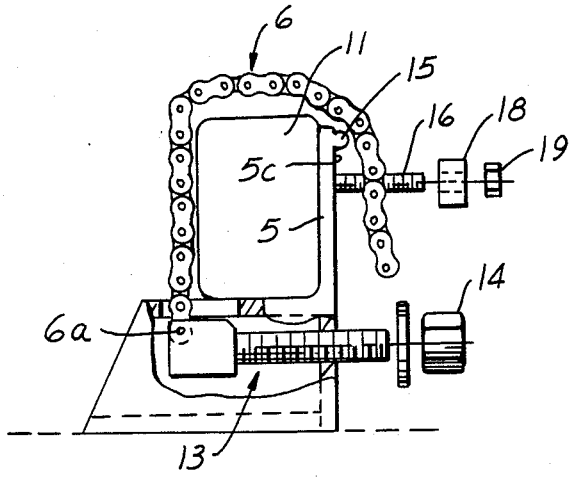
FIGS. 2–4 are perspective views illustrating three stages in securing a vehicle frame to the clamping device of FIG. 1.

In order to secure the frame member 11 as firmly and stably as possible, when in use the chains are received in slots or recesses 5a and 5b in the flange. Preferably, the bottom of each slot or recess is beneath or below the upper surface of the frame member, as shown in FIGS. 2–4, so that the chains lie against this upper surface of the frame member across substantially its entire width. To further improve stability, preferably the tensioner device 13 draws end 6a of the chain at least slightly around the lower edge or corner of the adjacent frame member spaced from the flange (lower left hand corner as viewed in FIGS. 2–4), when tightening the chain so that the chain will lie fully against the free side (left hand side as viewed in FIGS. 2–4) surface of the frame member across substantially its entire width. This insures that the bottom and one side (right hand) of the frame member will be firmly seated on the horizontal top wall 12 and side flange 5 of the support housing with the chains abutting the top and other side (left hand) of the frame member so that together they extend around the entire perimeter of the frame member and engage substantially the entire periphery of the frame member. Preferably, each chain 6 and 7 and the seat formed by flange 5 and top wall 12 of the support each abut and bear on approximately one-half of the perimeter of the frame member.

Each chain 6 and 7 has multiple links which preferably are pivotally connected together to form a chain capable of being flexed in substantially only one and the same plane in the manner of a roller chain common in bicycle sprocket drives. However, if desired the series of links of each chain may be connected together in a manner enabling the chain to be flexed freely.

When used the clamping device is mounted on a guide beam 9 secured to a straightening bench 10. The chains 6 and 7 are threaded through the holes 12a and 12b in the top wall 12 of the housing and the threaded shanks of the tensioner devices 13 are inserted through the wall 4, and preferably the washers and nuts 14 are started on the free ends of the studs. The chains are then wrapped around the frame 11 and passed through the slots 5a and 5b in the flange so that their free ends pass over the outside of the flange and the rib 15 as shown in FIG. 2. The clamp bar 18 is passed over the studs 16 and 17 and the nuts 19 are threaded and tightened on the studs to urge the bar into firm engagement with the chains and securely clamp them to the flange, as shown in FIG. 3. Thereafter, the nuts 14 of the tensioner devices 13 are tightened, as shown in FIG. 4, to tension the chains and draw them into firm engagement with the frame member 11 and force it into firm abutment with the seat provided by the flange 5 and the top wall 12 of the support housing. When desired, the device 1 can be released from the frame by loosening the clamp nuts 19 and retracting the clamp bar 18 so the chains can be removed from the flange and the frame member.

We claim:

1. A clamping device which comprises a support having a seat for receiving an object to be clamped, at least one clamping chain having a plurality of links for abutment with the object in a manner to hold said object against said support, a pocket carried by said support and constructed and arranged to receive at least one link of the chain, a chain clamp carried by said support and constructed and arranged to releasably clamp at least one link of the chain in said pocket in fixed relation to said support, and a tensioner carried by said support, connected to said chain, and constructed and arranged to tension the chain to bear on and urge such object against said support to hold such object thereon.

2. The clamping device of claim 1 wherein said support comprises a base housing having spaced apart top and bottom walls, end walls connected to said top and bottom walls, a side wall and an open side, a flange fixed to said housing and extending generally vertically beyond said top wall, and said top wall and said flange being at generally right angles to each other and constructed and arranged to bear on bottom and side portions of the object when it is clamped in the device.

3. The clamping device of claim 2 wherein said chain, top wall and flange are constructed and arranged to extend around and collectively engage substantially the whole periphery of the object when it is clamped in the device.

4. The clamping device of claim 2 wherein said tensioner comprises a spindle operably connected to said chain adjacent one end thereof and a nut threadedly engaging said spindle and constructed and arranged when rotated in one direction to displace said spindle relative to said support to draw said chain around the object and tension said chain to secure such object to the support.

5. The clamping device of claim 2 wherein said chain pocket comprises a horizontally extending and outwardly projecting rib on the outer surface of said upstanding flange, and said clamp comprises at least one outwardly projecting and threaded stud located on said flange and beneath said rib a distance approximately equal to one chain link spacing, a clamping bar received on said stud and a nut on said stud for releasably securing said bar in a position overlying said chain such that said bar clamps said chain in firm engagement with said flange below said rib.

6. The clamping device of claim 5 wherein said chain comprises a plurality of links which are pivotally connected such that the chain can be flexed in substantially only one plane.

7. The clamping device of claim 1 wherein said tensioner comprises a spindle operably connected to said chain adjacent one end thereof and a nut threadedly engaging said spindle and constructed and arranged when rotated in one direction to displace said spindle relative to said support to draw said chain around the object and tension said chain to secure such object to the support.

8. The clamping device of claim 1 wherein said support comprises a first member having a generally horizontally extending surface and an upstanding flange adjacent said first member and at generally a right angle to said horizontal surface, said chain pocket comprises a rib carried by said flange, projecting outwardly thereof and constructed and arranged to underlie and extend transversely across a portion of the chain when received over the flange and said rib, and said chain clamp comprises a member constructed and arranged to bear on at least one link of the chain adjacent to and below said rib to force such link under said rib and into engagement with said flange to thereby releasably secure the chain to said flange in fixed relation to said support.

9. The clamping device of claim 8 which also comprises a recess in said flange and above said rib in which said chain is received so that when said tensioner draws said chain into engagement with the object to secure it to the support the chain will lie against the upper surface of the object across substantially its entire width to firmly urge the object into engagement with said horizontal surface of said first member.

10. The clamping device of claim 9 wherein said chain also passes below said horizontal surface of said first member so that when said tensioner draws said chain into abutment with the object to secure it to the support such chain will extend across substantially the entire width of the free side of the object and firmly urge it into engagement with said flange.

11. The clamping device of claim 1 wherein said chain comprises a plurality of links which are pivotally connected such that the chain can be flexed in substantially only one plane.

* * * * *